US008079782B1

(12) United States Patent
Hilfiker et al.

(10) Patent No.: US 8,079,782 B1
(45) Date of Patent: Dec. 20, 2011

(54) SEMI-EXTENSIBLE STEEL SOIL REINFORCEMENTS FOR MECHANICALLY STABILIZED EMBANKMENTS

(76) Inventors: William K. Hilfiker, Grapevine, TX (US); William B. Hilfiker, Fortuna, CA (US); Harold K. Hilfiker, Eureka, CA (US)

( * ) Notice: Subject to any disclaimer, the term of this patent is extended or adjusted under 35 U.S.C. 154(b) by 220 days.

(21) Appl. No.: 12/466,859

(22) Filed: May 15, 2009

Related U.S. Application Data

(60) Provisional application No. 61/054,012, filed on May 16, 2008.

(51) Int. Cl.
*E02D 29/02* (2006.01)

(52) U.S. Cl. ..... 405/262; 405/284

(58) Field of Classification Search ..... 405/259.1, 405/262, 284, 285, 286
See application file for complete search history.

(56) References Cited

U.S. PATENT DOCUMENTS

| | | | | | |
|---|---|---|---|---|---|
| 1,762,343 | A | | 6/1930 | Munster | |
| 3,421,326 | A | * | 1/1969 | Vidal | 405/284 |
| 3,922,864 | A | | 12/1975 | Hilfiker | |
| 4,116,010 | A | * | 9/1978 | Vidal | 405/262 |
| 4,343,572 | A | | 8/1982 | Hilfiker | |
| 4,407,611 | A | | 10/1983 | Murray et al. | |
| 4,710,062 | A | * | 12/1987 | Vidal et al. | 405/262 |
| 4,834,584 | A | | 5/1989 | Hilfiker | |
| 4,929,125 | A | | 5/1990 | Hilfiker | |
| 4,993,879 | A | | 2/1991 | Hilfiker | |
| 5,044,833 | A | | 9/1991 | Wilfiker | |
| 5,407,303 | A | * | 4/1995 | Manns | 405/262 |
| 5,456,554 | A | * | 10/1995 | Barrett et al. | 405/284 |
| 5,494,379 | A | * | 2/1996 | Anderson et al. | 405/262 |
| 5,525,014 | A | * | 6/1996 | Brown | 405/262 |
| 5,531,547 | A | * | 7/1996 | Shimada | 405/262 |
| 5,533,839 | A | * | 7/1996 | Shimada | 405/284 |
| 6,024,516 | A | * | 2/2000 | Taylor et al. | 405/262 |
| 6,079,908 | A | * | 6/2000 | Anderson | 405/262 |
| 6,086,288 | A | | 7/2000 | Ruel et al. | |
| 6,336,773 | B1 | * | 1/2002 | Anderson et al. | 405/262 |
| 6,345,934 | B1 | * | 2/2002 | Jailloux et al. | 405/262 |
| 6,371,699 | B1 | | 4/2002 | Weinreb | |
| 6,517,293 | B2 | | 2/2003 | Taylor et al. | |
| 6,793,436 | B1 | * | 9/2004 | Ruel et al. | 405/262 |
| 7,073,983 | B2 | | 7/2006 | Hilfiker | |
| 7,270,502 | B2 | | 9/2007 | Brown | |
| 2003/0213203 | A1 | * | 11/2003 | Bott et al. | 405/262 |
| 2004/0179902 | A1 | * | 9/2004 | Ruel | 405/262 |
| 2007/0014638 | A1 | | 1/2007 | Brown | |

FOREIGN PATENT DOCUMENTS

| | | |
|---|---|---|
| JP | 61242225 A | 10/1986 |
| JP | 63284321 | 11/1988 |

* cited by examiner

*Primary Examiner* — Frederick L Lagman
(74) *Attorney, Agent, or Firm* — Eric Karich

(57) ABSTRACT

A mechanically stabilized embankment system has a connection element adapted for engaging a wall facing element. An elongate soil reinforcement element is adapted to be attached to the connection element and positioned in earthen embankment. A plurality of semi-extensible bent segments are integrally formed by and spaced on a middle portion of the elongate soil reinforcement element such that each semi-extensible bent segment extends laterally from an axis of the elongate soil reinforcement element, but can be pulled straight upon the application of excessive force that might otherwise break the elongate soil reinforcement element.

20 Claims, 10 Drawing Sheets

SEMI-EXTENSIBLE STEEL SOIL REINFORCEMENTS FOR MECHANICALLY STABILIZED EMBANKMENTS

CROSS-REFERENCE TO RELATED APPLICATIONS

This application for a utility patent claims the benefit of U.S. Provisional Application No. 61/054,012, filed May 16, 2008.

STATEMENT REGARDING FEDERALLY SPONSORED RESEARCH

Not Applicable

BACKGROUND OF THE INVENTION

1. Field of the Invention

This invention relates generally to mechanically stabilized embankment systems, and more particularly to a mechanically stabilized embankment system that includes a wall facing element connected to elongate soil reinforcement elements each having a plurality of semi-extensible bent segments spaced along the length of the soil reinforcement element.

2. Description of Related Art

The prior art teaches various forms of mechanically stabilized embankment systems for stabilizing earthen embankments. These systems include a wall facing element connected to elongate soil reinforcement elements that extend into the earthen embankment. The prior art elongate soil reinforcement elements fall into three categories: (1) extensible reinforcements made of plastic or other material that stretch under pressure, (2) non-extensible rods made of steel or the like that have a deformable region in a proximal end of the rod adjacent the wall facing element, to accommodate some relative movement between the rods and the wall facing element (e.g., in the event of an earthquake), and (3) non-extensible rods that are bent at a distal end for the purpose of anchoring the rod in the earthen embankment.

In the first category, extensible plastic reinforcements are effective in accommodating movement of the earthen embankment along the entire length of the reinforcements. The disadvantage of such systems is that the reinforcements are completely extensible, and there is nothing to limit the stretching of the reinforcements. Over-stretching the reinforcements weakens them and may cause movement of the face and failure of the system.

In the second category, non-extensible steel rods with deformable sections adjacent the wall facing element are useful in mitigating damage from earthquakes and some movement of the rods immediately adjacent the wall facing element, while still maintain support for the facing wall. Munster, U.S. Pat. No. 1,762,343, for example, teaches a system wherein the anchor elements are slidably attached to the retaining wall. Hilfiker, U.S. Pat. No. 4,343,572, teaches a system wherein the anchor elements include deformable sections adjacent the facing wall, so that the anchor element may move with the embankment in the event of an earthquake or other form of movement adjacent the facing wall.

While the steel rods of this second category function to deform under the stresses adjacent the wall, they are not able to accommodate stresses placed upon the rods inside the earthen embankment. Since the rods are not extensible within the earthen embankment, they must be made with sufficiently steel to prevent failure within the earthen embankment, this driving up the costs of the system The third category is of non-extensible steel rods having a bent "swiggle" anchor at the distal end opposite the wall. The "swiggle" anchor functions to anchor the rods more firmly in the earthen embankment. An example of such a construction is shown in Hilfiker, U.S. Pat. No. 4,834,584. However, this form of "swiggle" anchor is unable to accommodate movement within the earthen structure.

Other prior art patents of interest include Hilfiker, U.S. Pat. No. 7,073,983, Hilfiker, U.S. Pat. No. 4,929,125, Hilfiker, U.S. Pat. No. 4,993,879. All of the above-described references are hereby incorporated by reference in full.

The prior art provides extensible plastic reinforcements, and non-extensible steel rods that include deformable, bent portions at either the proximal or distal ends; however, the prior art does not teach semi-extensible elongate soil reinforcement elements that include bent sections through the middle of the elongate soil reinforcement elements, that are partially extensible. Such semi-extensible elements provide accommodation to movement within the earthen embankment, as described below, without weakening the elongate soil reinforcement elements. The present invention fulfills these needs and provides further related advantages as described in the following summary.

SUMMARY OF THE INVENTION

The present invention teaches certain benefits in construction and use which give rise to the objectives described below.

The present invention provides a mechanically stabilized embankment system for mechanically stabilizing an earthen embankment in conjunction with a wall facing element. The mechanically stabilized embankment system comprises an elongate soil reinforcement element adapted to be positioned in the earthen embankment, the elongate soil reinforcement element having a proximal end, a middle portion, and a distal end, the proximal end being adapted to be secured to the wall facing element; and a plurality of semi-extensible bent segments integrally formed by and spaced on the middle portion of the elongate soil reinforcement element such that each semi-extensible bent segment extends laterally from an axis of the elongate soil reinforcement element, but can be pulled straight upon the application of excessive force that might otherwise break the elongate soil reinforcement element.

A primary objective of the present invention is to provide a mechanically stabilized embankment system having advantages not taught by the prior art.

Another objective is to provide a mechanically stabilized embankment system that includes an elongate soil reinforcement element having a plurality of semi-extensible bent segments integrally formed by and spaced on the middle portion of the elongate soil reinforcement element, where maximum force occurs, such that the semi-extensible bent segments extend laterally from an axis of the elongate soil reinforcement element, but can be pulled straight upon the application of excessive force that might otherwise break the elongate soil reinforcement element.

Another objective is to provide a mechanically stabilized embankment system that includes an elongate soil reinforcement element that is semi-extensible and may extend a certain distance to accommodate a controlled movement within the earthen structure, but then becomes non-extensible and is not weakened by the partial extension.

A further objective is to provide a mechanically stabilized embankment system that allows sufficient movement within an earthen structure so that it may move to the "active" condition, thereby stabilizing the earthen structure and reducing the strain on the elongate soil reinforcement elements.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1A:
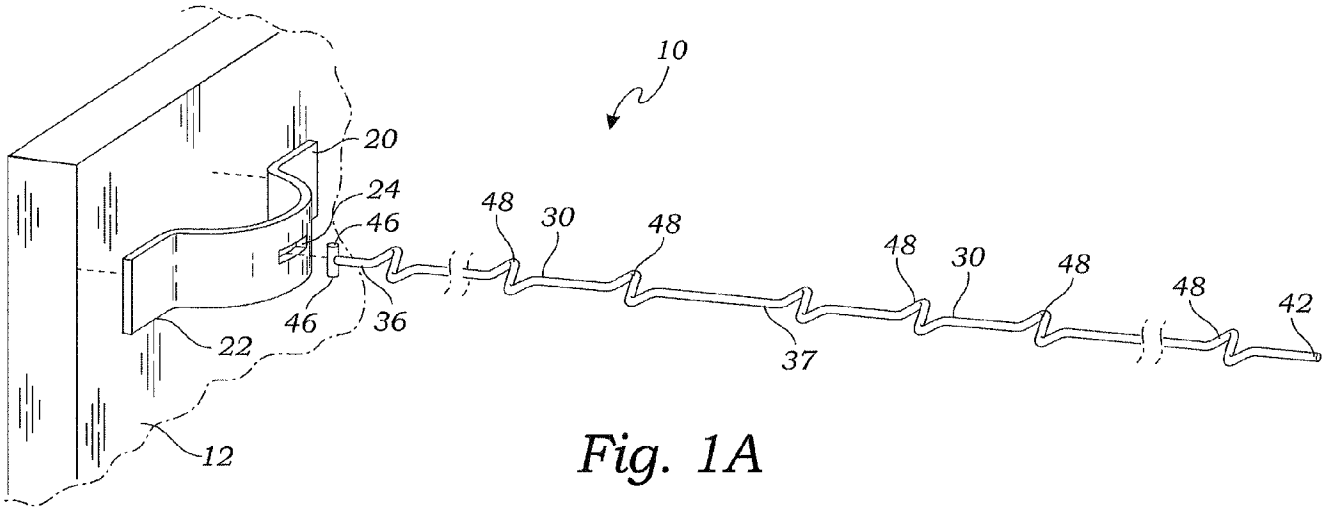
FIG. 1A is an exploded perspective view of a first embodiment of a mechanically stabilized embankment system, illustrating an elongate soil reinforcement element having a plurality of semi-extensible bent segments, and a connection element for attaching the elongate soil reinforcement element to a wall facing element.

The above-described drawing figures illustrate the invention, a mechanically stabilized embankment system 10. The mechanically stabilized embankment system 10 includes an elongate soil reinforcement element 30 having a plurality of semi-extensible bent segments 48. The system 10 may further include a means for securing the elongate soil reinforcement element 30 to a wall facing element 12, such as a connection element 20 for connecting the soil reinforcement element 30 to the wall facing element 12.

The semi-extensible bent segments 48 not only provide pullout resistance to the soil reinforcement element 30, they also enable a middle portion 37 of the soil reinforcement element 30, that is subjected to the maximum stresses, to extend a limited amount under excessive strain. This limited "semi-extensible" movement allows the backfill soil of the earthen embankment 15 to go into the active condition, thereby reducing the strain on the elongate soil reinforcement elements 30, without weakening the final strength of the soil reinforcement element 30.

Figure 1B:
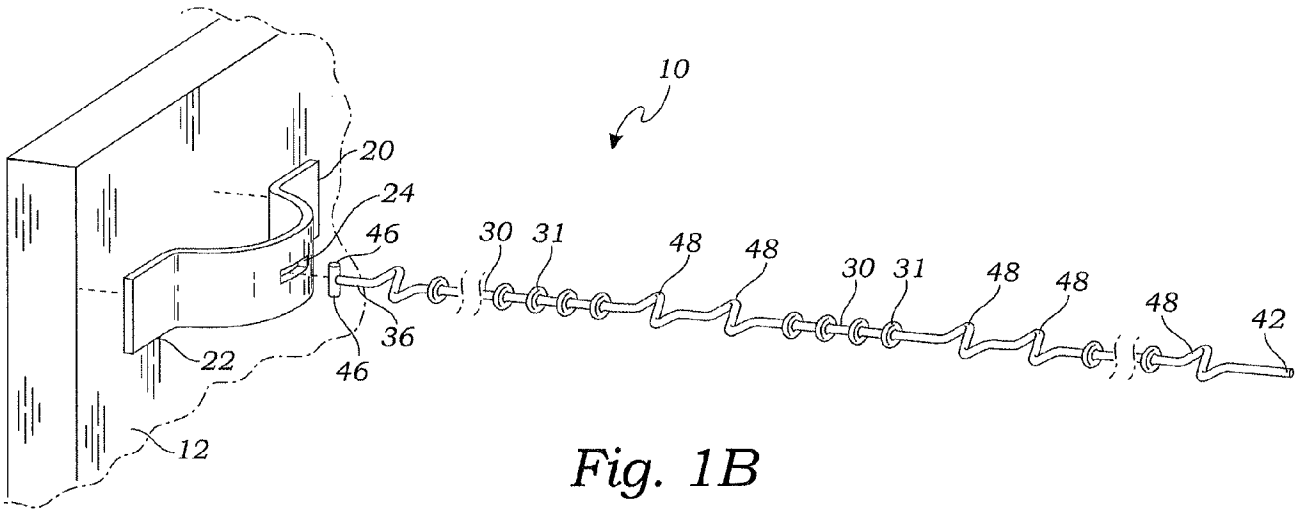
FIG. 1B is an exploded perspective view of an alternative embodiment of the mechanically stabilized embankment system of FIG. 1A, illustrating a plurality of ribs spaced along the length of the elongate soil reinforcement element.
Figure 2:
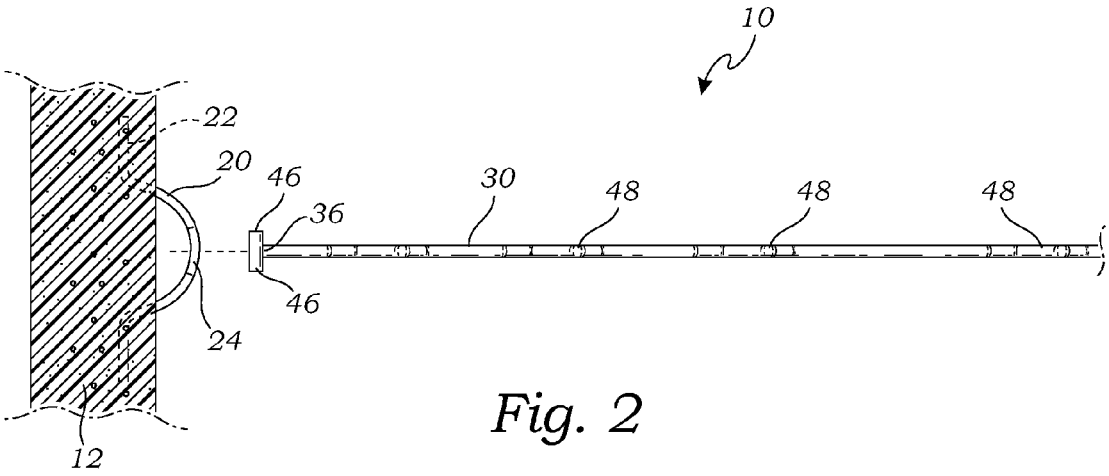
FIG. 2 is a top plan view thereof, illustrating the elongate soil reinforcement element once it has been rotated 90° for insertion into the connection element.
Figure 3:
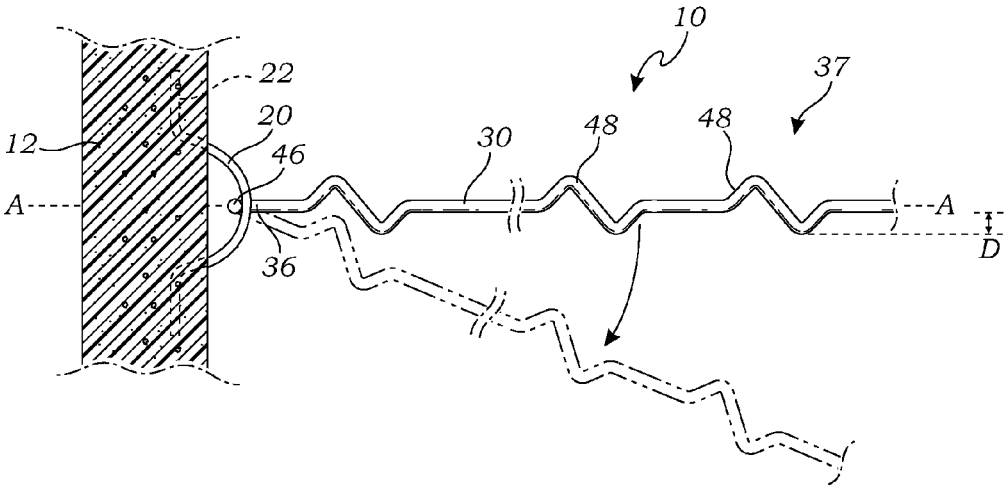
FIG. 3 is a top plan view thereof once the elongate soil reinforcement element has been inserted into the connection element and rotated back ninety degrees to a locked position.

FIGS. 1A and 1B are exploded perspective views of a first embodiment of the mechanically stabilized embankment system 10, illustrating a rod form of the elongate soil reinforcement element 30, with FIG. 1B including ribs 31 described in greater detail below. FIG. 2 is a top plan view thereof, illustrating the elongate soil reinforcement element 30 once it has been rotated 90° for insertion into a connection element 20. FIG. 3 is a top plan view thereof once the elongate soil reinforcement element 30 has been inserted into the connection element 20 and rotated back ninety degrees to a locked position.

As illustrated in FIGS. 1A-3, in a first embodiment the connection element 20 is a connection bracket. In this embodiment, the connection bracket 20 may include a wall engaging element 22 and a first interlocking element 24. The wall engaging element 22 is adapted for engaging the wall facing element 12. In the embodiment of FIGS. 1-3, the connection bracket 20 has a generally U-shaped cross-section, and the wall engaging element 22 is provided by outwardly extending flanges. In this embodiment, the wall facing element 12 is made of concrete, and when the concrete is poured, the connection bracket 20 is positioned such that the outwardly extending flanges 22 are locked within the setting concrete, using techniques well-known in the art.

The first interlocking element 24 is adapted for receiving and lockingly engaging the soil reinforcement element 30. In the embodiment of FIGS. 1-3, the first interlocking element 24 is a rectangular slot adapted to receive the soil reinforcement element 30, as described in greater detail below. Alternative interlocking elements may be devised by those skilled in the art, and should be considered within the scope of the present invention.

The elongate soil reinforcement element 30 includes a proximal end 36, a middle portion 37, and a distal end 42. In the embodiment of FIGS. 1-3, the elongate soil reinforcement element 30 is an elongate rod, and the semi-extensible bent segments 48 may be a deformable kinked section that are integrally formed by the elongate soil reinforcement element 30 and regularly spaced along the length of, or portion of, the middle portion 37 of the elongate soil reinforcement element 30, to extend laterally a distance D from the axis A (as illustrated in FIG. 3) of the element 30.

In one embodiment, the semi-extensible bent segments 48 may be generally V-shaped or Z-shaped elements. In alternative embodiments, some of which are discussed below, the semi-extensible bent segments 48 may have other shapes (e.g., C-shaped, or any other shape that provides for semi-extensibility), and may be formed in any suitable number and position as may be selected by one skilled in the art. The semi-extensible bent segments 48 are integrally formed by and spaced on the middle portion 37 of the elongate soil reinforcement element 30 such that each semi-extensible bent segments 48 extend laterally from the axis A, but can be pulled straight upon the application of excessive force that might otherwise break the elongate soil reinforcement element 30.

In one embodiment, the elongate soil reinforcement element 30 is made of a "non-extensible" material such as steel, aluminum, or other suitable material, such as is known to those skilled in the art (see American Association of State Highway and Transportation Officials (AASHTO) guidelines and standards). "Semi-extensible" elements are constructed of non-extensible materials but are physically bent to provide a measure of extensibility despite the non-extensible nature of the underlying material. These materials are used in preference to "extensible" materials such as plastics, which suffer disadvantages described above.

For purposes of this application, the term "soil reinforcement element" is hereby defined to include any form of elongate rod, strap, screw, bar, shaft, mesh, grid, and/or other similar and/or equivalent structure. The reinforcement element 30 may have an axis, which is hereby defined to include any form of general line adapted to bear the strain of supporting the wall facing element 12 against the weight of the earthen embankment.

The proximal end 36 of the elongate soil reinforcement element 30 includes a second interlocking element 46 adapted to lockingly engage the first interlocking element 24 of the connection bracket 20. In the present embodiment, a second interlocking element 46 includes a pair of outwardly extending posts that are generally perpendicular to the axis A of the elongate soil reinforcement element 30. The posts 46 may be inserted into the rectangular slot 24, as illustrated in FIG. 2, and when the elongate soil reinforcement element 30 is rotated 90°, as illustrated in FIG. 3, the posts 46 lockingly engage the connection bracket 20.

While some additional embodiments of the first and second interlocking elements 24 and 46 are discussed in greater detail below, any form of interlocking known in the art, or devisable by one skilled in the art consistent with the present invention, should be considered within the scope of the present invention.

As discussed above, the semi-extensible bent segments 48 enable the soil reinforcement element 30 to not only provide pull-out resistance, but to also withstand greater strains and/or deformations within the earthen embankment without breaking. When the earthen embankment exerts a strain against the elongate soil reinforcement element 30, or when the earthen embankment deforms the elongate soil reinforcement element 30 in other ways (e.g., shifting soil, or other conditions), the bent segments 48 enable the element 30 to extend somewhat before breaking Obviously, those skilled in the art may devise many alternative shapes and embodiments of the bent segments 48 (some of which are discussed in greater detail below), and such alternatives should be considered within the scope of the claimed invention. The distal end 42 is typically without any form of anchor or similar feature.

FIG. 1A illustrates one embodiment of the elongate soil reinforcement element 30, in which the body of the elongate soil reinforcement element 30 is smooth. FIG. 1B is an exploded perspective view of an alternative embodiment of the mechanically stabilized embankment system 10 of FIG. 1A, illustrating a plurality of ribs 31 spaced along the length of the elongate soil reinforcement element 30. The plurality of ribs 31 function to increase the pullout resistance of the elongate soil reinforcement element 30. In one embodiment, the ribs 31 are about ¼ inch high and spaced about 2 inches apart; however, those skilled in the art may devise alternative sizes, arrangements, and spacing, and such alternatives should be included within the scope of the present invention.

Figure 4:
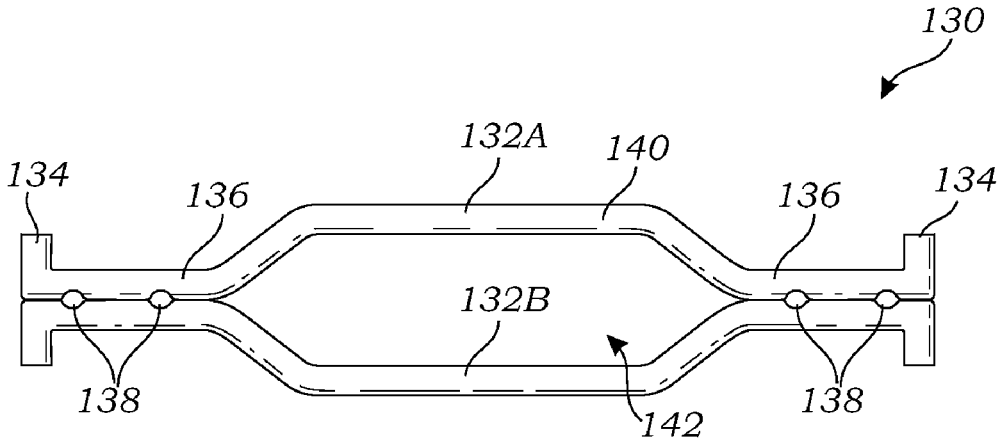
FIG. 4 is a front elevation view of an alternative embodiment of the connection element of FIGS. 1-3.
Figure 5:
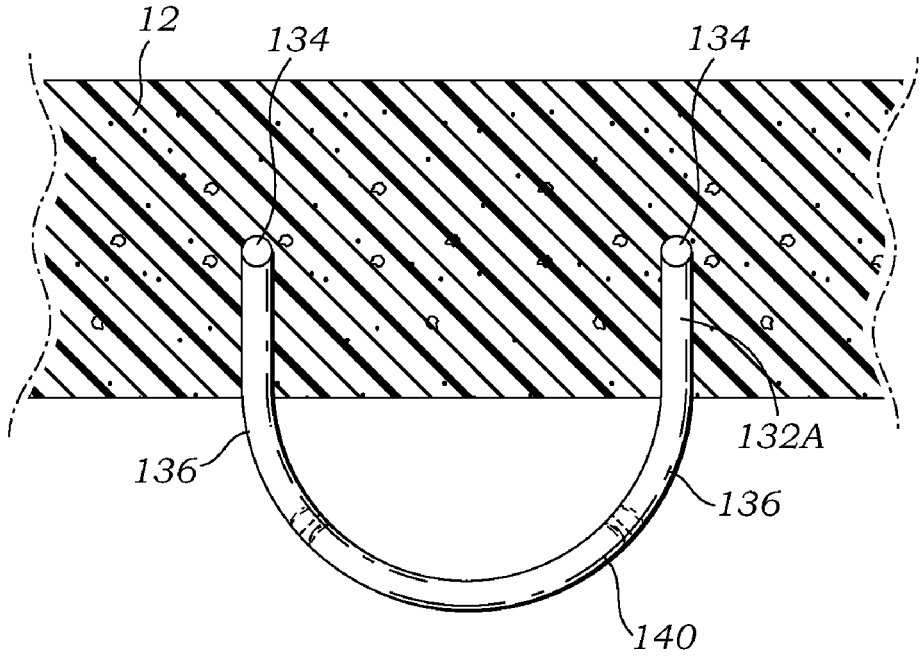
FIG. 5 is a top plan view thereof once the connection element has been bent into a generally C-shape.

FIG. 4 is a front elevation view of an alternative embodiment of the connection bracket 130 of FIGS. 1-3. FIG. 5 is a top plan view thereof once the connection bracket 130 has been bent into a generally C-shape. As illustrated in FIGS. 4 and 5, in the alternative embodiment of the connection bracket 130, the connection bracket 130 includes a top wire element 132A and a bottom wire element 132B, which may be mirror images of each other. Each wire element 132A and 132B includes upwardly extending flanges 134 at either end, an upwardly bent portion 140 in the middle, and middle portions 136 between the flanges 134 and the bent portion 140.

The wire elements 132A and 132B are connected together with welds 138 or similar or equivalent connection means, as illustrated in FIG. 4, and then the wire elements 132A and 132B are bent into the generally C-shaped cross-section, as illustrated in the FIG. 5. The flanges 134 may be embedded in the concrete of the wall facing element 12, for anchoring the connection bracket 130 in the wall facing element 12. The upwardly bent portions 140 of the wire elements 132A and 132B together form an aperture 142, illustrated in FIG. 4, that is adapted to receive the second interlocking element 46 of the elongate soil reinforcement element 30, as described above.

Figure 6:
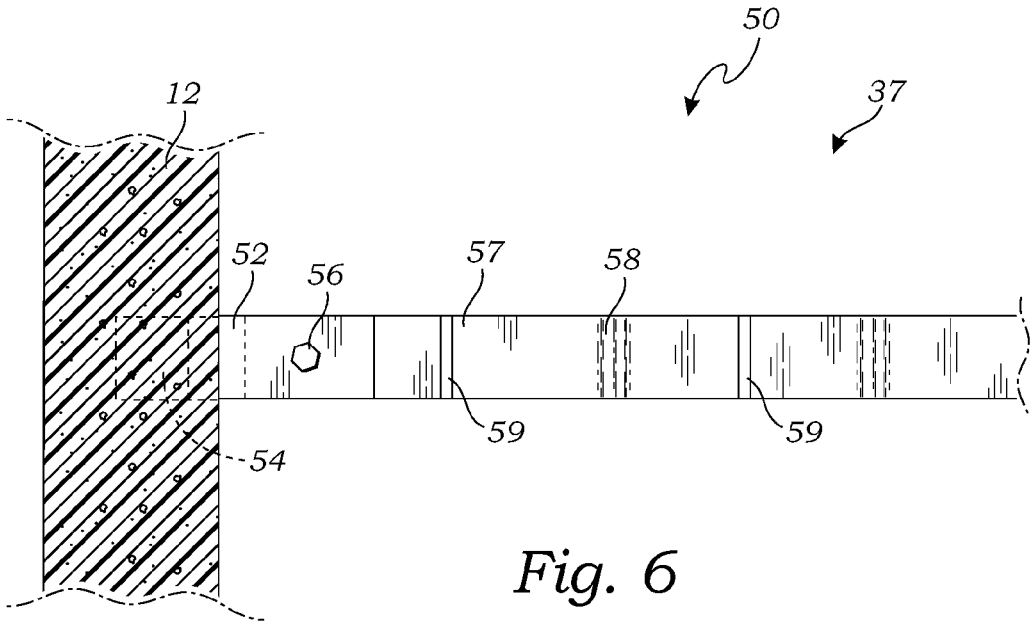
FIG. 6 is a top plan view of a second embodiment of the mechanically stabilized embankment system.
Figure 7:
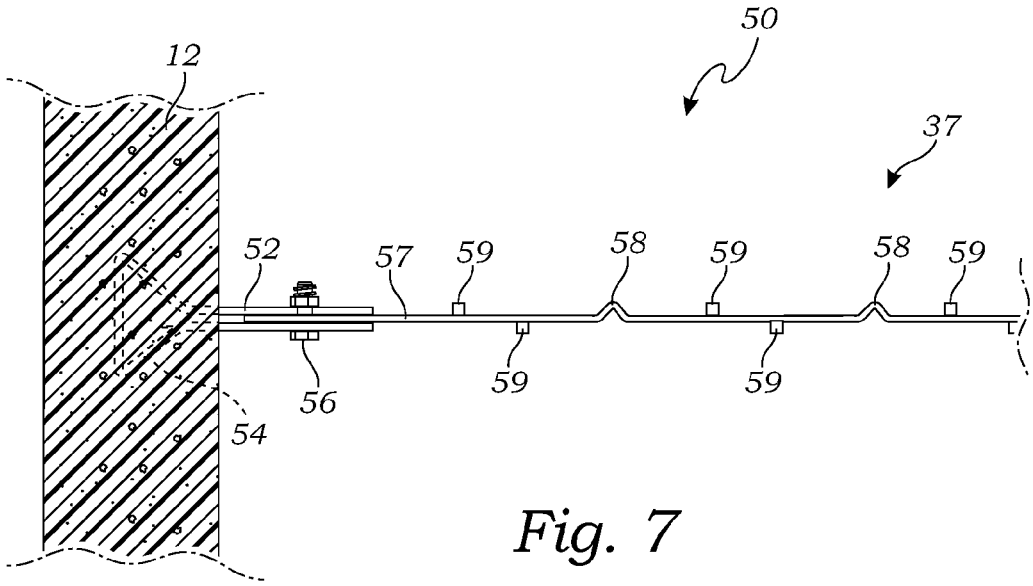
FIG. 7 is a side elevation view thereof.

FIG. 6 is a top plan view of a second embodiment of the mechanically stabilized embankment system 50, and FIG. 7 is a side elevation view thereof. As illustrated in FIGS. 6 and 7, the second embodiment of the mechanically stabilized embankment system 50 includes a connection bracket 52 that includes a loop 54 or similar feature that is adapted to be embedded in the concrete of the wall facing element 12. In the embodiment of FIGS. 6 and 7, the loop 54 has a generally triangular cross-section; however, it may be as any shape or configuration deemed suitable by one skilled in the art. In this embodiment, the soil reinforcement element is formed by a strap 57 that is attached to the connection bracket 52 with a bolt 56 or similar fastener.

As illustrated in FIG. 7, this embodiment of the soil reinforcement element is a strap 57 that is much wider than it is thick. The strap 57 includes V-shaped semi-extensible bent segments 58. The V-shape extends laterally, so that this portion of the strap 57 is semi-extensible and may be pulled straight to absorb strain without breaking.

Also illustrated in FIGS. 6 and 7, the strap 57 may also include ribs 59 in the form of ridges or similar structures to increase the pullout resistance of the strap 57, as discussed above.

Figure 8:
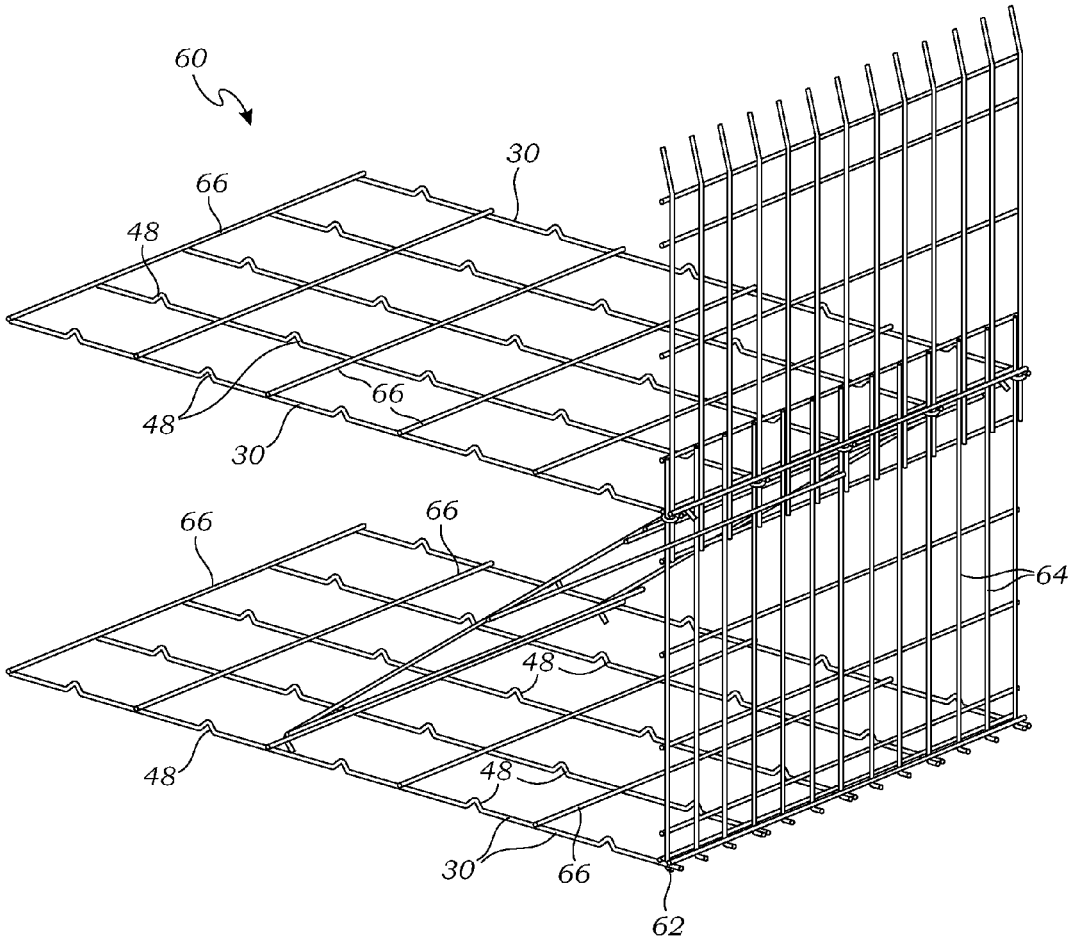
FIG. 8 is a perspective view of a third embodiment of the mechanically stabilized embankment system.

FIG. 8 is a perspective view of a third embodiment of the mechanically stabilized embankment system 60. As illustrated in FIG. 8, in this embodiment the connection bracket is provided by an engagement portion 62 of a wire mesh 64 that provides the wall facing element in this embodiment. The soil reinforcement elements 30 may be attached to each other with a plurality of lateral elements 66 (e.g., rods or other connectors), forming a horizontal mat structure that is adapted to be installed in the earthen embankment.

Figure 9:
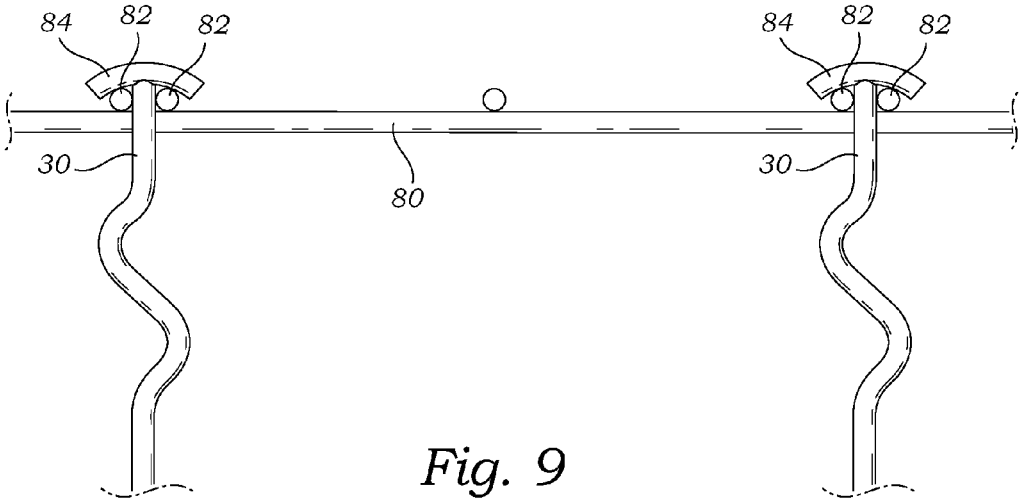
FIG. 9 is a top plan view of a fourth embodiment of the mechanically stabilized embankment system.

FIG. 9 is a top plan view of an alternative embodiment of the means for connecting the soil resistance elements 30 to the wall facing element, in this case a wire mesh 80 similar to the wire mesh 64 illustrated in FIG. 8. In this embodiment, the wire mesh 80 includes vertical supports 82 that are positioned in close proximity to each other, and these vertical supports 82 provide the connection element. The second interlocking element, in this embodiment, is provided by a C-shaped anchor 84 that is welded or otherwise attached to the soil resistance elements 30. The C-shaped anchor 84 may be positioned through the vertical supports 82, turned, and lockingly engage the vertical supports 82. Obviously, the term "C-shaped" is hereby defined to include any functionally similar element that may engage the wire mesh 80 or associated parts in a similar manner.

FIGS. 10A-10D are top plan views of another alternative embodiments of the means for connecting described in FIG. 9. In these embodiments, the connection element is provided by some portion of the wall, or a bracket attached thereto, and the second interlocking element is provided by the proximal end of the soil reinforcement element 30.

Figure 10A:
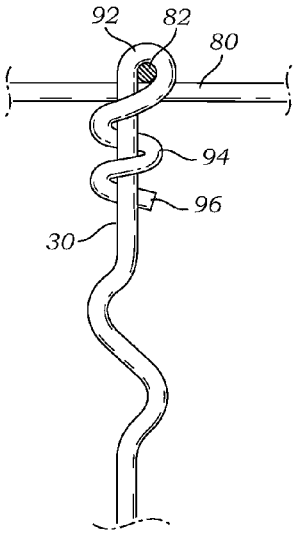
FIG. 10A-10D are top plan views of a fifth embodiment of the system, illustrating different embodiments of the connection between the elongate soil reinforcement element and the wall facing element.

As illustrated in FIG. 10A, in one embodiment the connection element is provided by part of the wire mesh 80, and the second interlocking element is provided by the proximal end 36 of the soil reinforcement element 30, which includes an integral bent portion 92 for engaging a single vertical support 82 (of the wire mesh 64 of FIG. 8). In the embodiment of FIG. 10A, the integral bent portion 92 may be bent to include a spiral portion 94 that extends to an end 96 that enables the integral bent portion 92 to be easily yet securely attached to the vertical support 82 by twisting the end 96 around the vertical support 82.

Figure 10B:
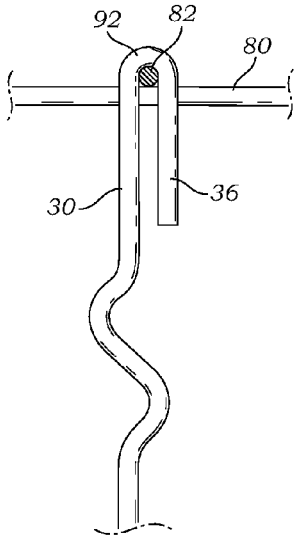

In the embodiment of FIG. 10B, the integral bent portion 92 is 180 degrees and then extends straight adjacent the soil reinforcement element 30. This embodiment relies upon the compacted soil adjacent the bent portion 92 to maintain the bend of the proximal end 36 around the vertical support 82, so that no twist is required, and the installation is made simpler.

Figure 10C:
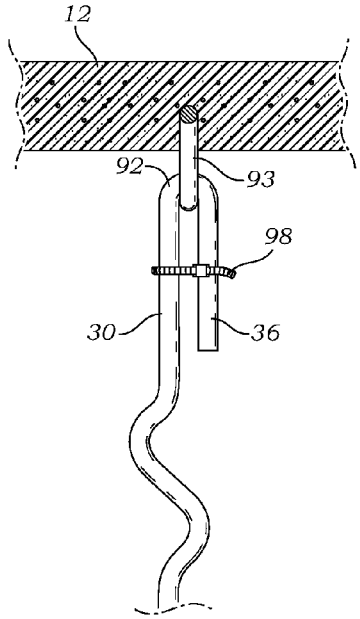
Figure 10D:
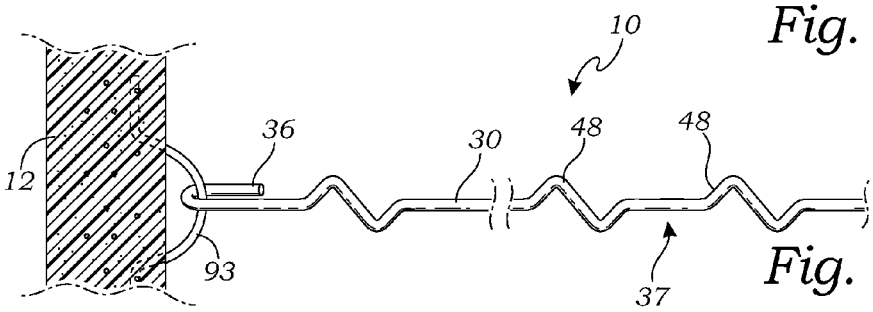

In the embodiment of FIG. 10C, the soil reinforcement element 30 is bent around a wire 93 (e.g. some form of loop, ring, or similar attachment point) that is embedded in the concrete of the wall 12. The proximal end 36 is bent around the wire 93, as in FIG. 10B, but in this embodiment a zip tie 98 or similar fastener may be used to further fasten the proximal end 36 in place to prevent unwanted movement. Likewise, FIG. 10D illustrates the proximal end 36 of the soil reinforcement element 30 being bent around the wire 93.

Figure 11:
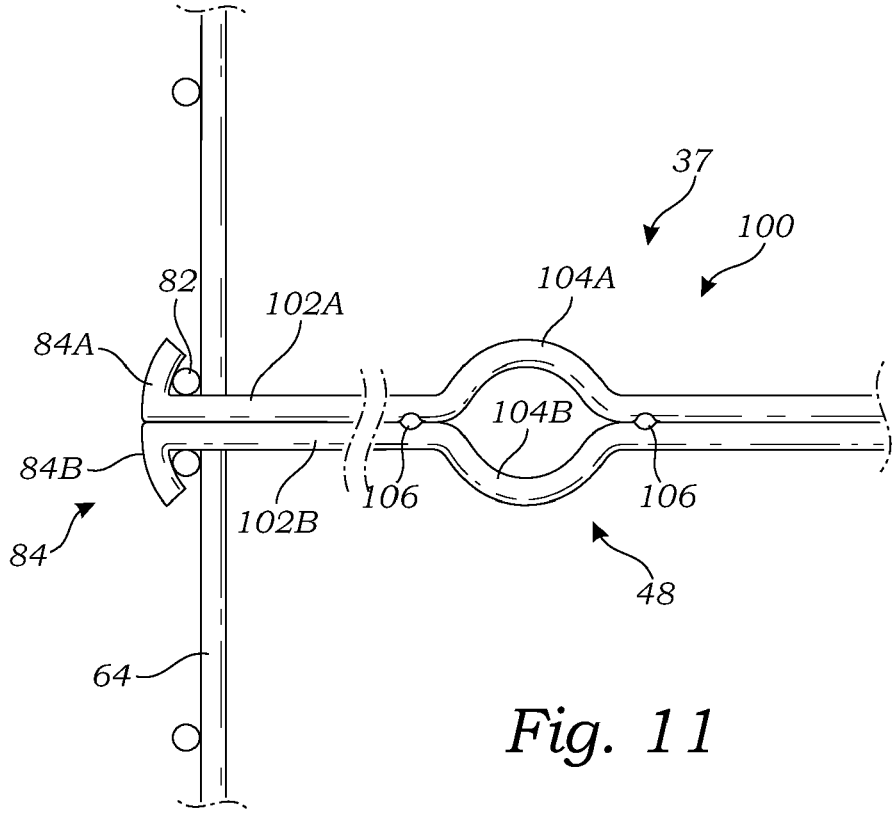
FIG. 11 is a top plan view of a sixth embodiment of the mechanically stabilized embankment system.
Figure 12:
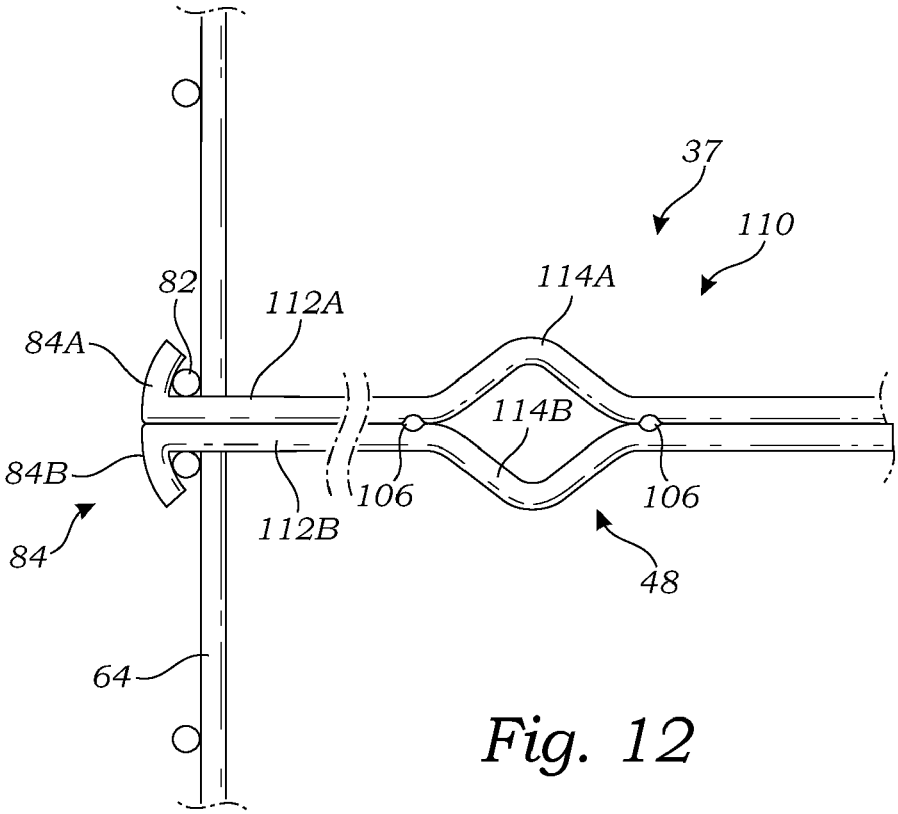
FIG. 12 is a top plan view of a seventh embodiment of the mechanically stabilized embankment system.

FIGS. 11 and 12 are additional alternative embodiments of the elongate soil reinforcement element 30 and the connection element 20, discussed above. In the embodiment of FIG. 11, the alternative embodiment of the elongate soil reinforcement element 100 includes first and second elements 102A and 102B connected together with welds 106 or similar attachment elements or means. This embodiment of the connection element 84 is formed by integral proximal ends 84A and 84B which are formed to engage vertical supports 82. Each of the first and second elements 102A and 102B includes opposing shaped elements 104A and 104B. In the embodiment of FIG. 11, the opposing shaped elements 104A and 104B are curved to form, together, a circle or oval.

In the embodiment of FIG. 12, first and second elements 112A and 112B include opposed shaped elements 114A and 114B that are bent to form, together, a square or rectangle. Those skilled in the art may devise alternative shapes with similar function, and such alternatives should be considered within the scope of the present invention.

Figure 13:
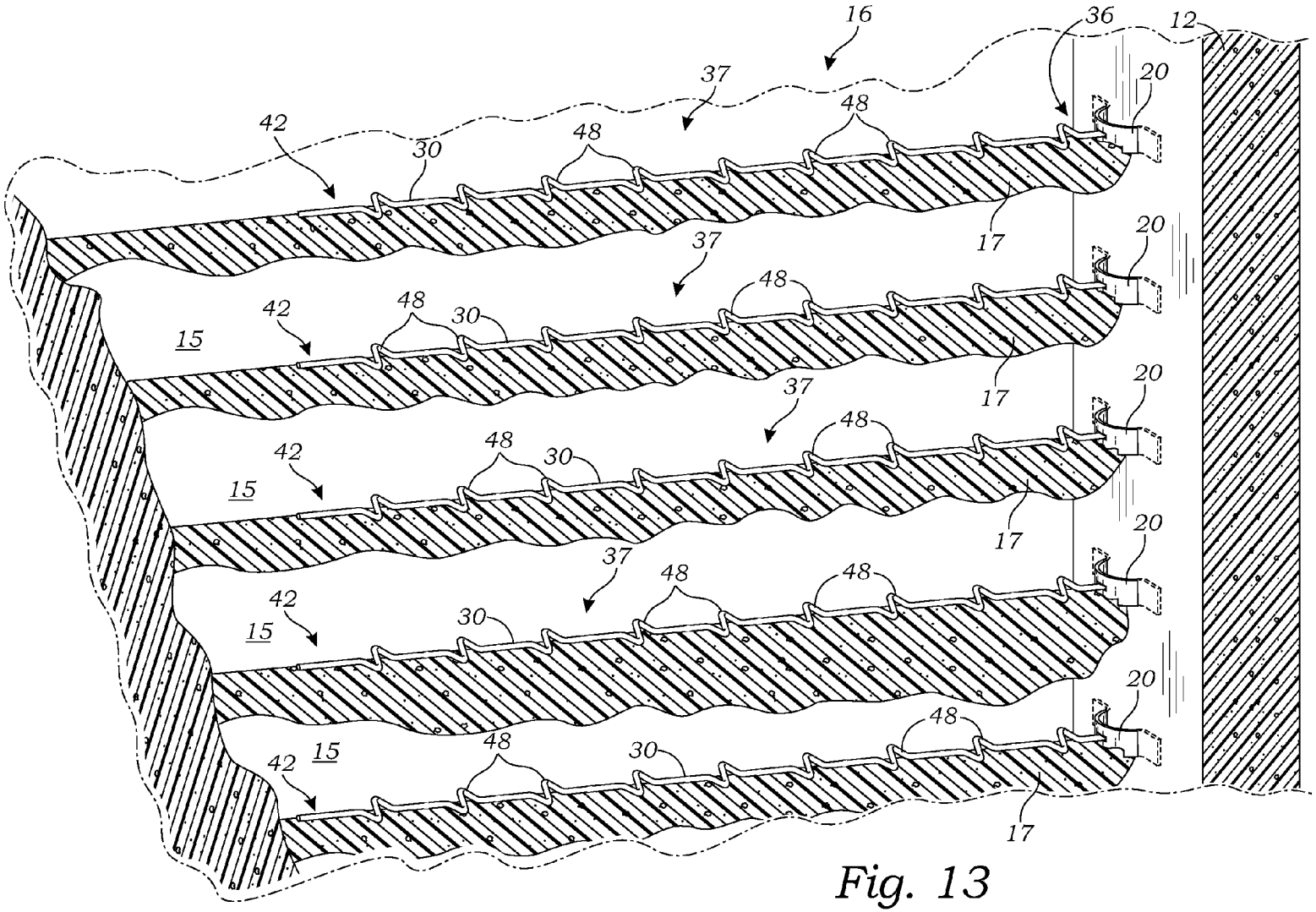
FIG. 13 is a perspective sectional view of an earthen embankment illustrating how the elongate soil reinforcement elements of FIG. 1A are positioned to stabilize the earthen embankment.

FIG. 13 is a perspective sectional view of an earthen embankment 15 illustrating how the earthen embankment 15 is constructed using the elongate soil reinforcement elements 30 of FIG. 1A. As illustrated in FIG. 13, the method for constructing the mechanically stabilized earthen embankment 15 in a location 16 comprises the steps of first constructing the wall facing element 12 adjacent the location 16 of the earthen embankment 15.

The elongate soil reinforcement elements 30 are each positioned adjacent the wall facing element 12 such that the elongate soil reinforcement elements 30 extend into the location 16 of the earthen embankment 15. The proximal ends 36 of each of the plurality of elongate soil reinforcement elements 30 are attached to the wall facing element 12. Fill soil 17 is then added to the location 16 to build the earthen embankment 15 over the plurality of elongate soil reinforcement elements 30.

Constructed in this manner, movement of the fill soil 17 may create sufficient force to straighten some of the plurality of semi-extensible bent segments 48 in the middle portions 37 of the plurality of elongate soil reinforcement elements 30, but insufficient force to break any of the plurality of elongate soil reinforcement elements 30. The semi-extensible bent segments 48 in the middle portion 37 of the elongate soil reinforcement elements 30 thereby enable movement of the embankment 15 to the active condition without breaking the elongate soil reinforcement elements 30. For purposes of this application, the term "earthen embankment" is hereby defined to include any form of earthen formation that is to be stabilized consistent with the present description.

Figure 14:
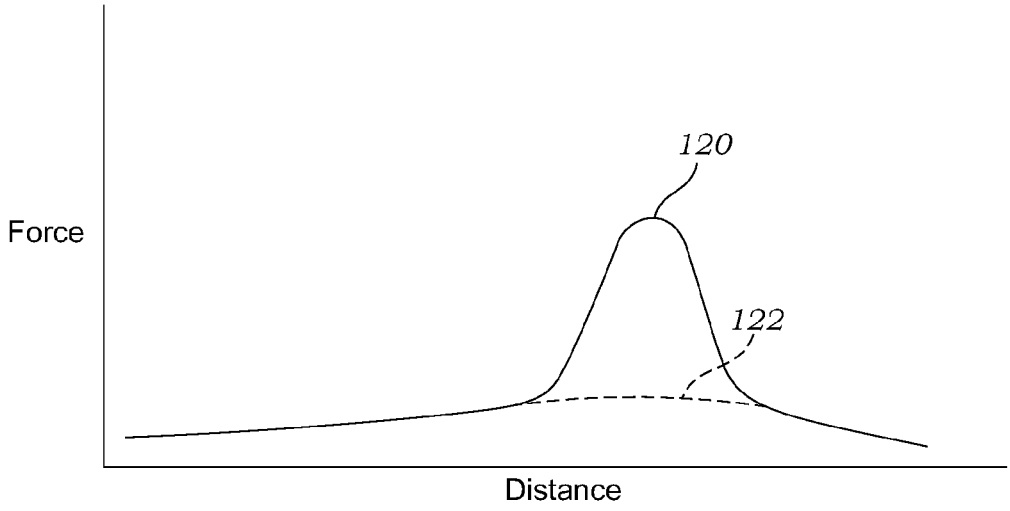
FIG. 14 is a graph illustrating how the plurality of semi-extensible bent segments function to reduce force at the locus of maximum force, thereby reducing stress on the mechanically stabilized embankment system.

FIG. 14 is a graph illustrating how the above-described mechanically stabilized embankment system 10 reduces force from the earthen embankment 15, thereby allowing the use of lighter steel. In a first instance 120, prior art systems result in a force spike at one particular portion of the soil reinforcement element, that requires steel strong enough to withstand the force. In a second instance 122, using the present invention, the soil reinforcement element is semi-extensible and able to extend somewhat in the affected portion, thereby enabling the backfill of the earthen embankment to go into "active" condition, and resist movement, thereby reducing the strain on the soil reinforcement elements. This reduced strain enables the use of lighter soil reinforcement elements, which require less steel, and therefore reduced costs.

Figure 15A:
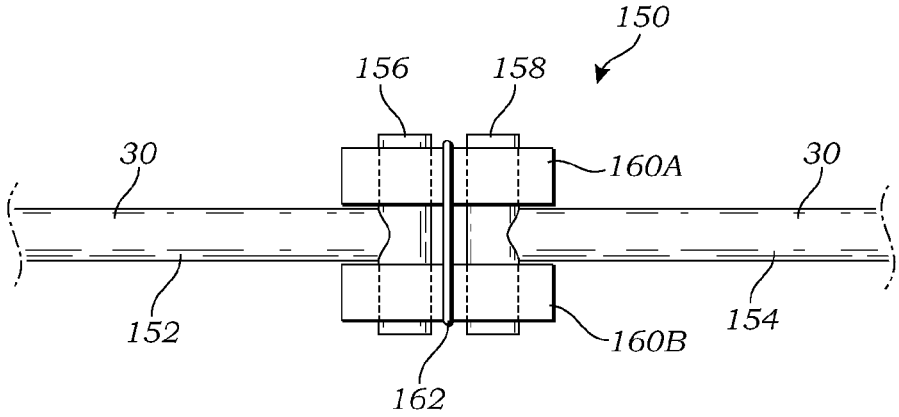
FIG. 15A is a side elevational view of a splicing element for splicing two different segments of the elongate soil resistance element.
Figure 15B:
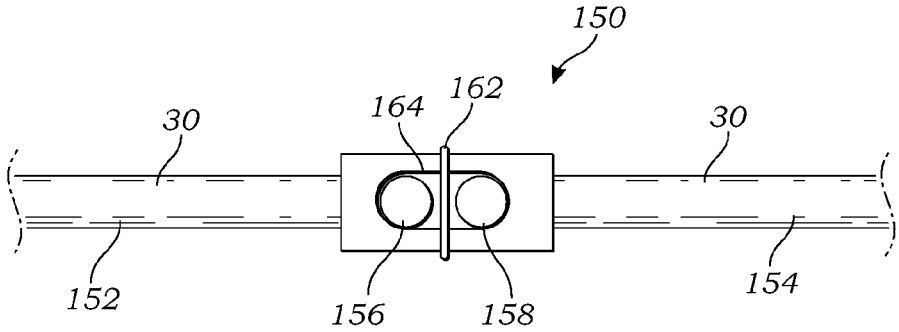
FIG. 15B is a top plan view thereof.

FIG. 15A is a side elevational view of a splicing element 150 for splicing two different segments 152 and 154 of the elongate soil reinforcement element 30, and FIG. 15B is a top plan view thereof. As illustrated in FIGS. 15A and 15B, it is sometimes necessary to splice the two different segments 152 and 154 of the elongate soil reinforcement element 30.

In this embodiment, the splicing element 150 is formed by T-sections 156 and 158 (or similar structures) of the two different segments 152 and 154, respectively, and a pair of locking elements 160A and 160B. The locking elements 160A and 160B are, for example, steel plates that include one or more locking apertures 164 for engaging the T-sections 156 and 158. A temporary fastener 162 such as a tie wire holds the locking elements 160A and 160B in place until the soil is added to cover the splicing element 150, after which the soil maintains the locking elements 160A and 160B in place.

Figure 16:
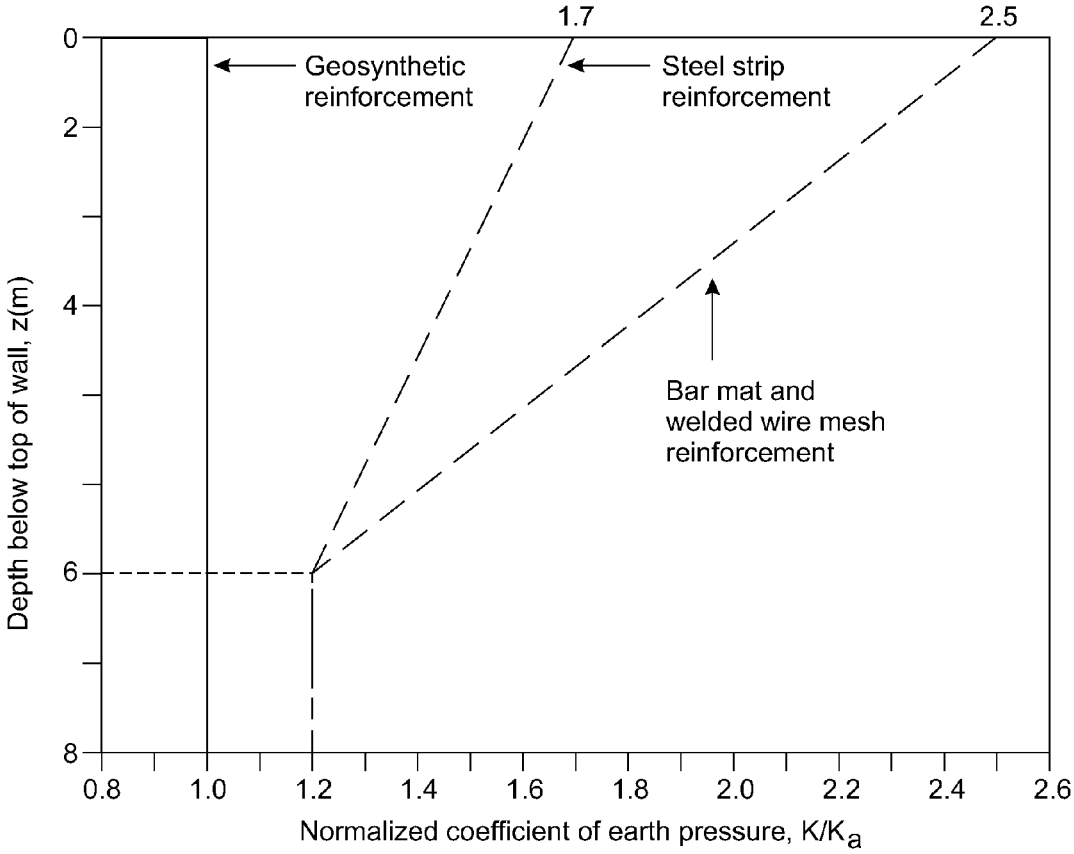
FIG. 16 is a graph illustrating a normalized coefficient of earth pressure relative to a depth below the top of the wall.

FIG. 16 is a graph illustrating a normalized coefficient of earth pressure relative to a depth below the top of the wall. As illustrated in FIG. 16, extensible geosynthetic reinforcements (such as plastic reinforcements) retain a K/Ka value of 1, while steel reinforcements require from 1.2-2.5 K/Ka. The utilization of semi-extensible reinforcement elements 30 should enable a steel product that has a K/Ka value of 1, without the disadvantages of the plastic products, described above.

The semi-extensible nature of the reinforcements utilized in the present application will result in the ability to utilize much less steel in the construction of the reinforcing elements 30, and thereby reduce the costs of the embankment system 10, without the disadvantages of other prior art systems that are fully extensible.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While some representative embodiments of the anchor system 10 are illustrated herein, the scope of the present invention should not be limited to these embodiments, but should include any alternative embodiments, constructions, and/or equivalent embodiments that might be devised by those skilled in the art.

What is claimed is:

1. A mechanically stabilized embankment system for mechanically stabilizing an earthen embankment in conjunction with a wall facing element, the mechanically stabilized embankment system comprising:

an elongate soil reinforcement element adapted to be positioned in the earthen embankment, the elongate soil reinforcement element having a proximal end, a middle portion, and a distal end, the proximal end being adapted to be secured to the wall facing element; and a plurality of semi-extensible bent segments integrally formed by and spaced on the middle portion of the elongate soil reinforcement element such that each semi-extensible bent segment extends laterally from an axis of the elongate soil reinforcement element, but provides some extensibility upon the application of excessive force that might otherwise break the elongate soil reinforcement element, wherein each elongate soil reinforcement element is made of two different segments, and further comprising a splicing element for splicing the two different segments of the elongate soil reinforcement element together, and wherein the splicing element is formed by T-sections of the two different segments, respectively, and a pair of locking elements that connect the T-sections of the different segments.

2. The mechanically stabilized embankment system of claim 1, wherein the elongate soil reinforcement element includes a plurality of ribs spaced along at least a portion of the length thereof, the plurality of ribs being adapted to increase the pull out resistance of the elongate soil reinforcement element.

3. The mechanically stabilized embankment system of claim 1, further comprising a connection element that includes a wall engaging element and a first interlocking element, the wall engaging element being adapted for engaging the wall facing element, and a receiver being adapted to engaging the elongate soil reinforcement element.

4. The mechanically stabilized embankment system of claim 3, wherein the connection element is a connection bracket that includes a generally U-shaped cross section, the wall engaging element includes outwardly extending flanges, and the first interlocking element includes a rectangular slot adapted to receive the soil reinforcement element.

5. The mechanically stabilized embankment system of claim 3, wherein the elongate soil reinforcement element includes a pair of outwardly extending posts that are generally perpendicular to the axis, the pair of outwardly extending posts being adapted to removably and pivotally engage the rectangular slot of the connection bracket.

6. The mechanically stabilized embankment system of claim 3, wherein the elongate soil reinforcement element may be pivotally connected to the connection element.

7. The mechanically stabilized embankment system of claim 3, wherein the connection element is a wire loop.

8. The mechanically stabilized embankment system of claim 7, wherein the wire loop includes a top wire element and a bottom wire element, each of the top and bottom wire elements including upwardly extending flanges, an upwardly bent portion, and middle portions between the flanges and the bent portion.

9. The mechanically stabilized embankment system of claim 8, wherein the top and bottom wire elements are connected together with welds, and then bent into the generally C-shaped cross-section.

10. The mechanically stabilized embankment system of claim 3, wherein the connection element includes vertical supports of the facing wall, and wherein the elongate soil reinforcement element includes an anchor that is adapted to engage at least one of the vertical supports of the facing wall.

11. The mechanically stabilized embankment system of claim 10, wherein anchor is a C-shaped anchor that is adapted to engage two of the vertical supports.

12. The mechanically stabilized embankment system of claim 3, wherein the connection element includes a vertical support of the facing wall, and wherein the proximal end of the elongate soil reinforcement element is adapted to be bent around the vertical support of the facing wall.

13. The mechanically stabilized embankment system of claim 12, further comprising a zip tie around the proximal end to fasten the proximal end against the elongate soil reinforcement element holding it in position around the vertical support of the facing wall.

14. The mechanically stabilized embankment system of claim 3, wherein the connection element includes vertical support of the facing wall, and wherein the elongate soil reinforcement element includes first and second elements connected together with welds, and wherein proximal ends are formed to engage the vertical supports.

15. The mechanically stabilized embankment system of claim 1, wherein the locking elements are steel plates that include one or more locking apertures for engaging the T-sections.

16. A mechanically stabilized embankment system for mechanically stabilizing an earthen embankment in conjunction with a wall facing element, the mechanically stabilized embankment system comprising:

an elongate soil reinforcement element adapted to be positioned in the earthen embankment, the elongate soil reinforcement element having a proximal end, a middle portion, and a distal end, the proximal end being adapted to be secured to the wall facing element;

a plurality of semi-extensible bent segments integrally formed by and spaced on the middle portion of the elongate soil reinforcement element such that each semi-extensible bent segment extends laterally from an axis of the elongate soil reinforcement element, but provides some extensibility upon the application of excessive force that might otherwise break the elongate soil reinforcement element; and a connection element that includes a wall engaging element and a first interlocking element, the wall engaging element being adapted for engaging the wall facing element, and a receiver being adapted to engaging the elongate soil reinforcement element, wherein the elongate soil reinforcement element includes a pair of outwardly extending posts that are generally perpendicular to the axis, the pair of outwardly extending posts being adapted to removably and pivotally engage the rectangular slot of the connection bracket.

17. A mechanically stabilized embankment system for mechanically stabilizing an earthen embankment in conjunction with a wall facing element, the mechanically stabilized embankment system comprising:

an elongate soil reinforcement element adapted to be positioned in the earthen embankment, the elongate soil reinforcement element having a proximal end, a middle portion, and a distal end, the proximal end being adapted to be secured to the wall facing element;

a plurality of semi-extensible bent segments integrally formed by and spaced on the middle portion of the elongate soil reinforcement element such that each semi-extensible bent segment extends laterally from an axis of the elongate soil reinforcement element, but provides some extensibility upon the application of excessive force that might otherwise break the elongate soil reinforcement element; and a connection element that includes a wall engaging element and a first interlocking element, the wall engaging element being adapted for engaging the wall facing element, and a receiver being adapted to engaging the elongate soil reinforcement element, wherein the connection element is a wire loop that includes a top wire element and a bottom wire element, each of the top and bottom wire elements including upwardly extending flanges, an upwardly bent portion, and middle portions between the flanges and the bent portion.

18. The mechanically stabilized embankment system of claim 17, wherein the top and bottom wire elements are connected together with welds, and then bent into the generally C-shaped cross-section.

19. A mechanically stabilized embankment system for mechanically stabilizing an earthen embankment in conjunction with a wall facing element, the mechanically stabilized embankment system comprising:

an elongate soil reinforcement element adapted to be positioned in the earthen embankment, the elongate soil reinforcement element having a proximal end, a middle portion, and a distal end, the proximal end being adapted to be secured to the wall facing element;

a plurality of semi-extensible bent segments integrally formed by and spaced on the middle portion of the elongate soil reinforcement element such that each semi-extensible bent segment extends laterally from an axis of the elongate soil reinforcement element, but provides some extensibility upon the application of excessive force that might otherwise break the elongate soil reinforcement element; and a connection element that includes a wall engaging element and a first interlocking element, the wall engaging element being adapted for engaging the wall facing element, and a receiver being adapted to engaging the elongate soil reinforcement element, wherein the connection element includes vertical supports of the facing wall, wherein the elongate soil reinforcement element includes an anchor that is adapted to engage at least one of the vertical supports of the facing wall, and wherein the anchor is a C-shaped anchor that is adapted to engage two of the vertical supports.

20. A mechanically stabilized embankment system for mechanically stabilizing an earthen embankment in conjunction with a wall facing element, the mechanically stabilized embankment system comprising:

an elongate soil reinforcement element adapted to be positioned in the earthen embankment, the elongate soil reinforcement element having a proximal end, a middle portion, and a distal end, the proximal end being adapted to be secured to the wall facing element;

a plurality of semi-extensible bent segments integrally formed by and spaced on the middle portion of the elongate soil reinforcement element such that each semi-extensible bent segment extends laterally from an axis of the elongate soil reinforcement element, but provides some extensibility upon the application of excessive force that might otherwise break the elongate soil reinforcement element; and a connection element that includes a wall engaging element and a first interlocking element, the wall engaging element being adapted for engaging the wall facing element, and a receiver being adapted to engaging the elongate soil reinforcement element, wherein the connection element includes vertical support of the facing wall, and wherein the elongate soil reinforcement element includes first and second elements connected together with welds, and wherein proximal ends are formed to engage the vertical supports.

* * * * *